United States Patent [19]

Kikuchi et al.

[11] Patent Number: 4,688,567

[45] Date of Patent: Aug. 25, 1987

[54] GAS MASK

[75] Inventors: Goro Kikuchi; Takeshi Kumazawa, both of Tokyo; Hiroshi Miura, Sagamihara, all of Japan

[73] Assignee: Tensho Electric Industries Co., Ltd., Tokyo, Japan

[21] Appl. No.: 822,225

[22] Filed: Jan. 24, 1986

[30] Foreign Application Priority Data

Nov. 5, 1985 [JP] Japan ..... 60-247779

[51] Int. Cl.[4] ..... A62B 7/10

[52] U.S. Cl. ..... 128/206.15; 128/206.17; 2/426

[58] Field of Search ..... 128/201.25, 205.27, 128/205.28, 205.29, 206.12, 206.16, 206.17; 55/DIG. 33, DIG. 35

[56] References Cited

U.S. PATENT DOCUMENTS

| | | | |
|---|---|---|---|
| 476,486 | 6/1892 | Pozdena | 128/206.17 |
| 1,443,820 | 1/1923 | Hudson | 128/205.29 |
| 3,381,454 | 5/1968 | Sponsel et al. | 128/205.27 |
| 4,098,270 | 7/1978 | Dolby | 128/206.12 |
| 4,179,274 | 12/1979 | Moon | 128/206.17 |
| 4,231,118 | 11/1980 | Nakagawa | 128/201.25 |
| 4,572,178 | 2/1986 | Takase et al. | 128/205.27 |
| 4,573,464 | 3/1986 | Yo | 128/206.17 |

FOREIGN PATENT DOCUMENTS

| | | | |
|---|---|---|---|
| 0197093 | 11/1979 | Japan | 128/205.27 |

OTHER PUBLICATIONS

Hackh's Chemical Dictionary, "Maganese", 1969, p. 406.

*Primary Examiner*—Henry J. Recla
*Assistant Examiner*—Karin M. Reichle
*Attorney, Agent, or Firm*—Wenderoth, Lind & Ponack

[57] ABSTRACT

This invention relates to a gas mask used for refuge in a fire, for example. The gas mask comprises a cylindrical mask body of fire-proof soft rubber material detachably connected to goggles of transparent or semitransparent fire-proof material. A cartridge is detachably inserted into and secured to the cylindrical mask body and comprises filter layers and a pack of catalyst which is a composite of copper oxide and manganic oxide and a drying agent laminated on the catalyst.

5 Claims, 3 Drawing Figures

GAS MASK

BACKGROUND OF THE INVENTION

There have been developed various gas masks which are used for refuge in a fire. Many prior gas masks comprise either filter layers which have active carbon interposed between the adjacent filter layers or a catalyst of noble metal such as expensive platinum. Such gas masks are disadvantageous since they cannot be reused and therefore have to be discarded after a length of time.

Futhermore, although the gas mask of filter layers with or without active carbon interposed therebetween can remove particles of white and black smoke from the air, they cannot fully absorb poisonous gases such as carbon monoxide, which causes the user to inhale them. Although the catalyst of noble metal such as platinum can effectively convert carbon monoxide into harmless carbon oxide, it is disadavantageously expensive and tends to quickly deteriorate in function when even a little organic matter in the form of particles of white and black smoke contacts the surface of the catalyst. Also, the prior gas masks have to be discarded after use or storage during a predetermined period, which is expensive. The users do not have a feeling of confidence of whether they can be used in a safe manner or not. Particularly, the gas mask having the catalyst of noble metal provided serves no function in case it is stored under poor conditions or in case the catalyst of noble metal is damaged by smoke.

SUMMARY OF THE INVENTION

Accordingly, it is a principal object of the invention to provide a gas mask adapted to be produced in an inexpensive manner.

It is another object of the invention to provide a gas mask adapted to maintain the function of a catalyst even though it is moistened.

It is a further object of the invention to provide a gas mask in which a catalyst can be easily exchanged when the function of the catalyst becomes poor.

It is a further object of the invention to provide a gas mask adapted to effectively remove particles of black and white smoke to provide clean air to the user.

In accordance with the invention, there is provided a gas mask comprising a mask body of fire-proof soft rubber material, a cartridge detachably inserted into and secured to said mask body and including filters and a pack of catalyst which is a composite of copper oxide and manganic oxide, and a drying agent.

BRIEF DESCRIPTION OF THE DRAWINGS

The above and other objects and features of the invention will be apparent from the description of an embodiment taken along with reference to the accompanying drawings in which.

DETAILED DESCRIPTION OF THE INVENTION

Figure 1:
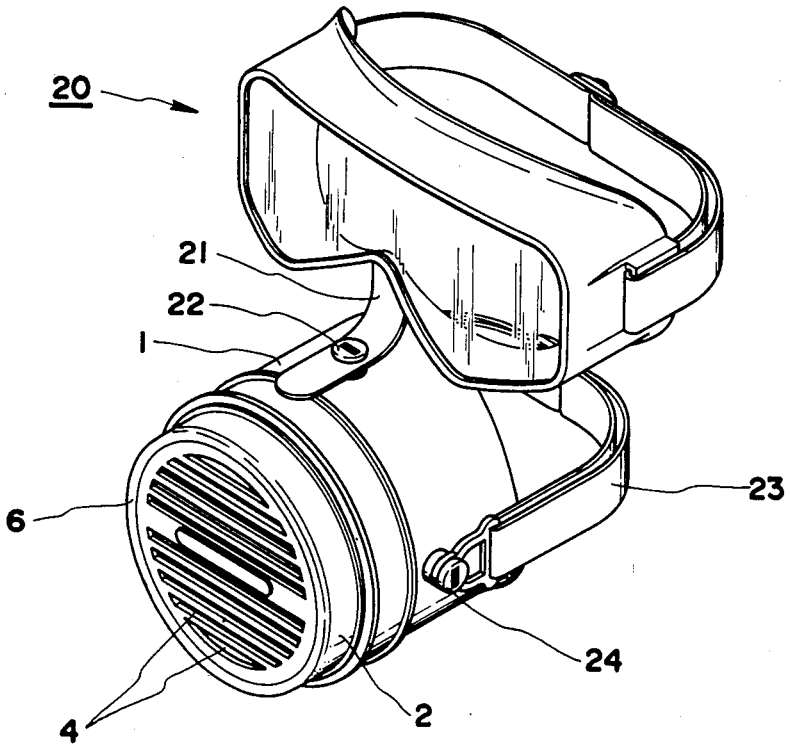
FIG. 1 is a perspective view of a gas mask constructed in accordance with one embodiment of the invention.
Figure 2:
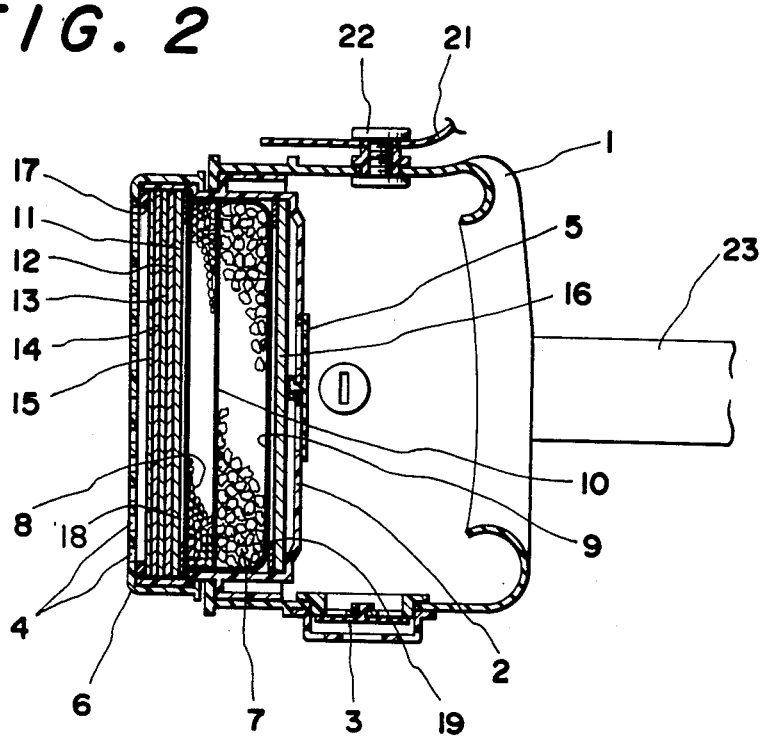
FIG. 2 is a cross sectional view of a mask body used for the invention.

Referring now to FIGS. 1 and 2, there is shown a gas mask constructed in accordance with one embodiment of the invention. The gas mask comprises a cylindrical mask body 1 of fire-proof soft rubber. The cylindrical mask body 1 has a mouth and nose engaging portion provided at one end thereof. A cartridge 2 is detachably inserted into, closely engages and is secured to an inner periphery of the mask body 1. An exhaust valve 3 is provided at a bottom of the mask body 1. The exhaust valve 3 is closed when the user inhales and opened when the user exhales.

Figure 3:
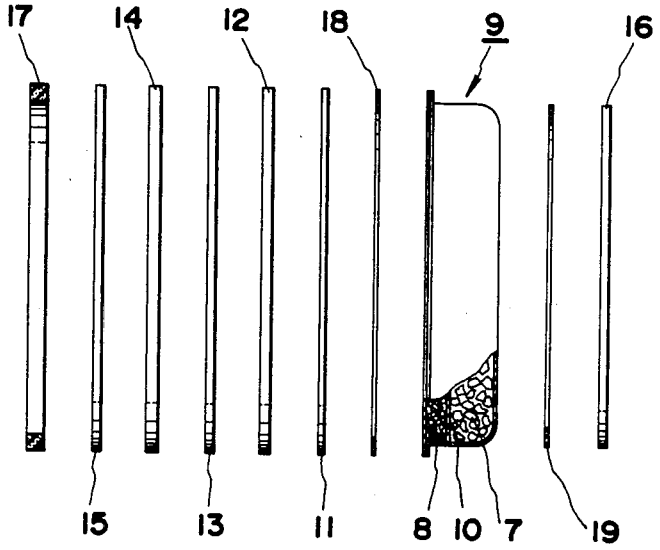
FIG. 3 is an exploded side elevational view of components in a cartridge used for the invention.

The cartridge 2 may be in the form of a disk and is formed of fire-proof synthetic resin. It has perforations 4 provided in a front plate portion and an inhaling valve 5 mounted on a back plate portion. The inhaling valve 5 is opened when the users inhale. A cap 6 may be detachably mounted on the cartridge 2 at its front portion. The perforations 4 are provided in the cap 6. In the cartridge 2 there is exchangably contained a pack 9 including catalyst 7 which is a composite of copper oxide (CuO) and manganic oxide ($Mn_2O_3$) and drying agent 8 of molecular sieve such as synthetic zeolite (trademark), for example. The pack 9 may include polyolefine non-woven fabric allowing ventilation, by which catalyst 7 and drying agent 8 are enclosed. In the illustrated embodiment, the catalyst 7 and drying agent 8 may be in the form of particles or granules. As shown in FIG. 3, the pack 9 may be partitioned into two chambers by non-woven fabric partition 10 with the catalyst 7 contained in the back chamber and with the drying agent 8 of molecular sieve contained in the front chamber.

More particularly, the catalyst 7 is inexpensive and readily converts carbon monoxide (CO) into carbon dioxide ($CO_2$). The catalyst 7 tends to have poor function when it is moistened. Thus, in order that the pack 9 has low humidity, the catalyst 7 is laminated with the drying agent 8 of molecular sieve through the non-woven fabric partition 10. Molecular sieve rather than silica gel is used as the drying agent because molecular sieve has hygroscopic property higher than silica gel. Thus, even though the catalyst 7 is moistened, it cannot be dried if the drying agent is of silica gel, but it can be dried if the drying agent is of molecular sieve. Also, since the drying agent 8 is contained in the pack 9, it can be easily exchanged after its use or storage over a length of time.

In front of the pack 9 are sequentially disposed a filter 11 of electrification processing non-woven fabric, a filter 12 of active carbon, a filter 13 of electrification porcessing material, and two filters 14 and 15 of rough non-woven fabric, and in back of the pack 9 is disposed a filter 16 of fine non-woven fabric. As shown in FIGS. 2 and 3, a sealing rubber packing 17 is disposed in front of the filter 15. A sealing packing 18 is disposed between the pack 9 and the filter 11 of electrification processing non-woven fabric. A sealing packing 19 is disposed between the pack 9 and the filter 16 of fine non-woven fabric.

Eye protecting goggles 20 are formed of transparent or semitransparent fire-proof synthetic resin. The goggles 20 have a band 21 mounted thereon. The goggles 20 are detachably connected to the mask body 1 by engaging the band 21 with a protrusion 22 on the mask body 1. The mask body 1 has a band 23 provided to mount it on the head of the user. The band 23 may be detachably engaged with a protrusion 24 on the mask body 1.

The user wears the gas mask when a fire occurs, and can inhale through the gas mask. Relatively large particles of soot and smoke in the air coming through the cartridge 2 can be removed by the two rough filters 14 and 15. The electrification processing filter 13 can remove particles of white and black smoke out of the air. Then, the filter 12 of active carbon can remove gases other than carbon monoxide and the electrification processing filter 11 can remove the remaining particles of white and black smoke. The catalyst 7 which is a composite of copper oxide and manganic oxide reacts active carbon monoxide with oxygen to produce carbon dioxide. Finally, the filter 16 of fine non-woven fabric can remove fine particles of white and black smoke. Thus cleaned air is fed into the mask body 1 and inhaled by the user and the user exhales through the exhaust valve 3.

It should be noted that the catalyst composite of copper oxide and manganic oxide is inexpensive and readily converts poisonous gases into harmless gases. Furthermore, since the drying agent of molecular sieve is contained in the pack, the catalyst can be always maintained in an active state because it can be dried after it is moistened. An active state cannot be maintained by the prior platinum catalyst because it functions poorly when it contacts smoke. Also, it cannot be obtained by the drying agent of silica gel. Thus, it will be noted that the user can safely take refuge from the fire.

It should be also noted that since the pack can be removed out of the mask body, the catalyst composite of copper oxide and manganic oxide as well as the drying agent can be exchanged by opening the cap of the cartridge after its use or its storage over a length of time. It will be noted that the filters can be exchanged by opening the cap of the cartridge. The cartridge itself may be replaced by a new one. Thus, it will be understood that the gas mask can be maintained so that it always has an excellent function of cleaning air.

The eye protecting goggles serve to protect eyes of the user from being damaged in a fire while the user takes refuge. Of course, the gas mask may be used while the user works in an atmosphere of smoke.

While one preferred embodiment of the invention has been illustrated and described with reference to the accompanying drawings, it will be understood by those skilled in the art that it is by way of example and that various changes and modifications may be made without departing from the spirit and scope of the invention, which is intended to be defined only by the appended claims.

What is claimed is:

1. A gas mask comprising a mask body of fireproof soft rubber material adapted to cover at least a wearer's oro-nasal region and defining a chamber in fluid communication therewith and having means to secure said mask to the wearer, exhaust valve means, and a filter cartridge detachably inserted into said chamber and secured to said mask body and including an air inlet, an air outlet extending between said cartridge and said chamber, an air flow path between said inlet and outlet and valve means associated with said outlet for permitting fluid communication between said cartridge and said chamber upon inhalation by the wearer, and filters and a pack of a catalyst composite of copper oxide and manganic oxide and a molecular sieve drying agent, positioned in said air flow path wherein said filters include, in order from said pack to said inlet, a first filter of electrification processing non-woven fabric, a filter of active carbon, a second filter of electrification processing material and two filters of non-woven fabric, and a filter of fine non-woven fabric disposed between said pack and said outlet, and wherein said pack is formed of a polyolefine non-woven fabric and is partitioned by a non-woven fabric partition into a front chamber adjacent said first electrification filter and a back chamber adjacent said filter of fine non-woven fabric with said drying agent being contained in said front chamber and said catalyst being contained in said back chamber.

2. A gas mask as set forth in claim 1 wherein said cartridge has a front plate portion having perforations defining said inlet and an opposite back plate portion defining said outlet and having said inlet valve means, and said exhaust valve means being provided at the bottom of said mask body.

3. A gas mask as set forth in claim 1 wherein said mask body is detachably connected to eye protecting goggles.

4. A gas mask as set forth in claim 1 wherein said catalyst and said drying agent are in particulate form.

5. A gas mask as set forth in claim 1 wherein said catalyst and said drying agent are in granular form.

* * * * *